US009169700B2

(12) United States Patent
Curtis et al.

(10) Patent No.: US 9,169,700 B2
(45) Date of Patent: Oct. 27, 2015

(54) PRESSURE CONTROL DEVICE WITH REMOTE ORIENTATION RELATIVE TO A RIG

(75) Inventors: Fredrick D. Curtis, Houston, TX (US); Derrick W. Lewis, Conroe, TX (US); Leyb Ginzburg, Calgary (CA)

(73) Assignee: Halliburton Energy Services, Inc., Houston, TX (US)

( * ) Notice: Subject to any disclaimer, the term of this patent is extended or adjusted under 35 U.S.C. 154(b) by 211 days.

(21) Appl. No.: 13/026,034

(22) Filed: Feb. 11, 2011

(65) Prior Publication Data

US 2011/0203802 A1 Aug. 25, 2011

(30) Foreign Application Priority Data

Feb. 25, 2010 (WO) ..... PCT/US2010/025385

(51) Int. Cl.

| | |
|---|---|
| ***E21B 43/00*** | (2006.01) |
| ***E21B 41/00*** | (2006.01) |
| ***E21B 33/06*** | (2006.01) |
| ***E21B 19/00*** | (2006.01) |

(52) U.S. Cl.

CPC ..... *E21B 19/006* (2013.01); *E21B 19/004* (2013.01)

(58) Field of Classification Search

CPC ..... E21B 41/00; E21B 19/006; E21B 19/004
USPC ..... 166/334, 53, 66.4, 255.2, 341, 345, 166/355, 84.3, 92.1, 338, 343, 85.5, 78.1; 175/7

See application file for complete search history.

(56) References Cited

U.S. PATENT DOCUMENTS

| | | | | |
|---|---|---|---|---|
| 3,387,851 | A | 6/1968 | Cugini | |
| 3,472,518 | A | 10/1969 | Harlan | |
| 3,621,912 | A | 11/1971 | Wooddy, Jr. et al. | |
| 3,760,875 | A * | 9/1973 | Busking | 166/354 |
| 4,098,341 | A | 7/1978 | Lewis | |
| 4,456,062 | A | 6/1984 | Roche et al. | |
| 4,626,135 | A | 12/1986 | Roche | |
| 4,668,126 | A | 5/1987 | Burton | |

(Continued)

FOREIGN PATENT DOCUMENTS

| | | |
|---|---|---|
| EP | 1432887 B1 | 3/2003 |
| EP | 1488073 B1 | 8/2003 |

(Continued)

OTHER PUBLICATIONS

Search Report issued Mar. 17, 2011, for International Patent Application Serial No. PCT/US2010/025385, 5 pages.

(Continued)

*Primary Examiner* — James G Sayre
(74) *Attorney, Agent, or Firm* — Chamberlain Hrdlicka

(57) ABSTRACT

A method of maintaining a substantially fixed orientation of a pressure control device relative to a movable rig can include rotating a body of the pressure control device while the rig rotates. A method of remotely controlling an orientation of a pressure control device relative to a movable rig can include rotating a body of the pressure control device, and controlling the rotation of the body from a location on the rig remote from the body. A pressure control device for use in conjunction with a rig can include a body, a flange, an orientation device which changes a rotational orientation of the body relative to the flange, and an orientation control system which remotely controls the orientation device.

32 Claims, 7 Drawing Sheets

(56) References Cited

U.S. PATENT DOCUMENTS

| | | | | |
|---|---|---|---|---|
| 4,712,620 | A * | 12/1987 | Lim et al. | 166/355 |
| 4,813,495 | A | 3/1989 | Leach | |
| 5,178,215 | A | 1/1993 | Yenulis et al. | |
| 5,224,557 | A | 7/1993 | Yenulis et al. | |
| 5,277,249 | A | 1/1994 | Yenulis et al. | |
| 5,279,365 | A | 1/1994 | Yenulis et al. | |
| 5,419,398 | A * | 5/1995 | Askestad | 166/355 |
| 5,647,444 | A | 7/1997 | Williams | |
| 5,662,181 | A | 9/1997 | Williams et al. | |
| 5,720,356 | A | 2/1998 | Gardes | |
| 6,065,550 | A | 5/2000 | Gardes | |
| 6,109,348 | A | 8/2000 | Caraway | |
| 6,129,152 | A | 10/2000 | Hosie et al. | |
| 6,138,774 | A | 10/2000 | Bourgoyne, Jr. et al. | |
| 6,230,824 | B1 | 5/2001 | Peterman et al. | |
| 6,244,359 | B1 | 6/2001 | Bridges et al. | |
| 6,263,982 | B1 * | 7/2001 | Hannegan et al. | 175/7 |
| 6,325,159 | B1 | 12/2001 | Peterman et al. | |
| 6,457,540 | B2 | 10/2002 | Gardes | |
| 6,470,975 | B1 | 10/2002 | Bourgoyne et al. | |
| 6,547,002 | B1 | 4/2003 | Bailey et al. | |
| 6,554,016 | B2 | 4/2003 | Kinder | |
| 6,702,012 | B2 | 3/2004 | Bailey et al. | |
| 6,732,804 | B2 | 5/2004 | Hosie et al. | |
| 6,749,172 | B2 | 6/2004 | Kinder | |
| 6,904,981 | B2 | 6/2005 | Van Riet | |
| 6,913,092 | B2 | 7/2005 | Bourgoyne et al. | |
| 6,981,561 | B2 | 1/2006 | Krueger et al. | |
| 7,004,444 | B2 | 2/2006 | Kinder | |
| 7,007,913 | B2 | 3/2006 | Kinder | |
| 7,040,394 | B2 | 5/2006 | Bailey et al. | |
| 7,044,237 | B2 | 5/2006 | Leuchtenberg | |
| 7,055,627 | B2 | 6/2006 | Fontana et al. | |
| 7,080,685 | B2 | 7/2006 | Bailey et al. | |
| 7,096,975 | B2 | 8/2006 | Aronstam et al. | |
| 7,134,489 | B2 | 11/2006 | Van Riet | |
| 7,159,669 | B2 | 1/2007 | Bourgoyne et al. | |
| 7,174,975 | B2 | 2/2007 | Krueger et al. | |
| 7,185,718 | B2 | 3/2007 | Gardes | |
| 7,185,719 | B2 | 3/2007 | Van Riet | |
| 7,237,623 | B2 | 7/2007 | Hannegan | |
| 7,258,171 | B2 | 8/2007 | Bourgoyne et al. | |
| 7,264,058 | B2 | 9/2007 | Fossli | |
| 7,270,185 | B2 | 9/2007 | Fontana et al. | |
| 7,278,496 | B2 | 10/2007 | Leuchtenberg | |
| 7,350,597 | B2 | 4/2008 | Reitsma et al. | |
| 7,353,887 | B2 | 4/2008 | Krueger et al. | |
| 7,367,410 | B2 | 5/2008 | Sangesland | |
| 7,367,411 | B2 | 5/2008 | Leuchtenberg | |
| 7,380,590 | B2 | 6/2008 | Hughes et al. | |
| 7,395,878 | B2 | 7/2008 | Reitsma et al. | |
| 7,487,837 | B2 | 2/2009 | Bailey et al. | |
| 7,497,266 | B2 | 3/2009 | Fossli | |
| 7,513,310 | B2 | 4/2009 | Fossli | |
| 7,562,723 | B2 | 7/2009 | Reitsma | |
| 7,650,950 | B2 | 1/2010 | Leuchtenberg | |
| 7,658,228 | B2 | 2/2010 | Moksvold | |
| 7,677,329 | B2 | 3/2010 | Stave | |
| 7,699,109 | B2 | 4/2010 | May et al. | |
| 7,708,064 | B2 | 5/2010 | Sehsah | |
| 7,721,822 | B2 | 5/2010 | Krueger et al. | |
| 7,779,903 | B2 | 8/2010 | Bailey et al. | |
| 7,806,203 | B2 | 10/2010 | Krueger et al. | |
| 7,836,946 | B2 | 11/2010 | Bailey et al. | |
| 7,926,560 | B2 | 4/2011 | Bailey et al. | |
| 7,926,593 | B2 | 4/2011 | Bailey et al. | |
| 8,028,750 | B2 | 10/2011 | Hughes et al. | |
| 8,033,335 | B2 | 10/2011 | Orbell et al. | |
| 2002/0112888 | A1 | 8/2002 | Leuchtenberg | |
| 2003/0066650 | A1 | 4/2003 | Fontana et al. | |
| 2003/0098181 | A1 | 5/2003 | Aronstam et al. | |
| 2004/0206548 | A1 | 10/2004 | Aronstam et al. | |
| 2006/0065402 | A9 | 3/2006 | Fontana et al. | |
| 2006/0086538 | A1 | 4/2006 | Van Riet | |
| 2006/0102387 | A1 | 5/2006 | Bourgoyne et al. | |
| 2006/0169491 | A1 | 8/2006 | Fossli | |
| 2007/0068704 | A1 | 3/2007 | Krueger et al. | |
| 2007/0240875 | A1 | 10/2007 | Van Riet | |
| 2007/0278007 | A1 | 12/2007 | Krueger et al. | |
| 2008/0105434 | A1 | 5/2008 | Orbell et al. | |
| 2008/0105462 | A1 | 5/2008 | May et al. | |
| 2008/0251257 | A1 | 10/2008 | Leuchtenberg | |
| 2009/0057021 | A1 | 3/2009 | Williams | |
| 2009/0101351 | A1 | 4/2009 | Hannegan | |
| 2009/0129868 | A1 | 5/2009 | Millheim | |
| 2009/0211239 | A1 | 8/2009 | Askeland | |
| 2010/0006297 | A1 | 1/2010 | Stave | |
| 2010/0018715 | A1 | 1/2010 | Orbell et al. | |
| 2010/0024195 | A1 | 2/2010 | Yoshitsune et al. | |
| 2011/0009298 | A1 | 1/2011 | Dobson, Jr. et al. | |
| 2011/0024195 | A1 | 2/2011 | Hoyer et al. | |
| 2011/0108282 | A1 | 5/2011 | Koziez et al. | |
| 2011/0127040 | A1 | 6/2011 | Humphreys | |
| 2011/0168392 | A1 | 7/2011 | Bailey et al. | |

FOREIGN PATENT DOCUMENTS

| | | | |
|---|---|---|---|
| EP | 1595057 | B1 | 9/2004 |
| EP | 1664478 | B1 | 2/2005 |
| EP | 1356186 | B1 | 6/2005 |
| EP | 2050924 | A2 | 4/2009 |
| EP | 2053196 | A1 | 4/2009 |
| EP | 2208855 | A2 | 1/2010 |
| EP | 2216498 | A2 | 8/2010 |
| EP | 2378056 | A2 | 10/2011 |
| GB | 2478119 | A | 8/2011 |
| WO | 9942696 | A1 | 8/1999 |
| WO | 0183941 | A1 | 11/2001 |
| WO | 0190528 | A1 | 11/2001 |
| WO | 0244518 | A1 | 6/2002 |
| WO | 03025334 | A8 | 3/2003 |
| WO | 03025336 | A1 | 3/2003 |
| WO | 03071091 | A9 | 8/2003 |
| WO | 2004005667 | A1 | 1/2004 |
| WO | 2004074627 | A1 | 9/2004 |
| WO | 2004085788 | A3 | 10/2004 |
| WO | 2005001237 | A1 | 1/2005 |
| WO | 2005017308 | A1 | 2/2005 |
| WO | 2006029379 | A1 | 3/2006 |
| WO | 2006031119 | A1 | 3/2006 |
| WO | 2006099362 | A1 | 9/2006 |
| WO | 2006118920 | A3 | 11/2006 |
| WO | 2006138565 | A1 | 12/2006 |
| WO | 2007008085 | A1 | 1/2007 |
| WO | 2007016000 | A1 | 2/2007 |
| WO | 2007030017 | A1 | 3/2007 |
| WO | 2007081711 | A3 | 7/2007 |
| WO | 2007112291 | A3 | 10/2007 |
| WO | 2007124330 | A3 | 11/2007 |
| WO | 2008120025 | A2 | 10/2008 |
| WO | 2008127894 | A2 | 10/2008 |
| WO | 2008133523 | A1 | 11/2008 |
| WO | 2008134266 | A1 | 11/2008 |
| WO | 2008151128 | A9 | 12/2008 |
| WO | 2008156376 | A1 | 12/2008 |
| WO | 2009017418 | A1 | 2/2009 |
| WO | 2009018448 | A2 | 2/2009 |
| WO | 2009058706 | A2 | 5/2009 |
| WO | 2009086442 | A3 | 7/2009 |
| WO | 2009123476 | A1 | 10/2009 |
| WO | 2010065646 | A3 | 6/2010 |
| WO | 2010095947 | A1 | 8/2010 |
| WO | 2011104279 | A2 | 9/2011 |

OTHER PUBLICATIONS

Written Opinion issued Mar. 17, 2011, for International Patent Application Serial No. PCT/US2010/025385, 3 pages.

International Search Report with Written Opinion issued Nov. 26, 2010 for PCT Patent Application No. PCT/US10/025385, 8 pages.

Halliburton; "RCD 500: Rotating Control Device", product article H05284, dated Jan. 2008, 4 pages.

Weatherford; "Weatherford Model 7800 Rotating Control Device", product article 4683.00, dated 2007, 5 pages.

(56) References Cited

OTHER PUBLICATIONS

Weatherford; "Model 7875 Rotating Control Device", product article 4594.01, dated 2010, 4 pages.
Weatherford; "Offshore Drilling Hazard Mitigation: Controlled Pressure Drilling Redefines What is Drillable", Drilling Contractor magazine article, dated Jan./Feb. 2009, 4 pages.
Smith Services; "HOLD 2500 Rotating Control Device", product article ss-04-0055 .10M, dated 2004, 4 pages.
Smith Services; "Marine Riser RCD", product presentation, dated Jul. 2009, 18 pages.
Australian Examination Report issued Dec. 3, 2012 for Australian Patent Application No. 2010346598, 4 pages.
European Office Action issued Feb. 14, 2014 for EPC Patent Application No. 10 846 760.6-1610, 5 pages.
European Examination Report issued Jul. 11, 2014 for EPC Patent Application No. 10 846 760.6-1610, 4 pages.

* cited by examiner

PRESSURE CONTROL DEVICE WITH REMOTE ORIENTATION RELATIVE TO A RIG

CROSS-REFERENCE TO RELATED APPLICATION

This application claims the benefit under 35 USC §119 of the filing date of International Application Serial No. PCT/US10/25385, filed Feb. 25, 2010. The entire disclosure of this prior application is incorporated herein by this reference.

BACKGROUND

The present disclosure relates generally to equipment utilized and operations performed in conjunction with a subterranean well and, in an embodiment described herein, more particularly provides a pressure control device which is remotely oriented relative to a rig.

Some floating rigs can move relative to a riser assembly. For example, a drill ship or a semi-submersible can be dynamically positioned relative to a riser assembly.

Unfortunately, such movement sometimes includes rotation of the rig relative to the riser assembly. As a result, any lines or cables extending between the rig and the riser assembly can become tangled, damaged, etc.

Therefore, it will be appreciated that improvements are needed in the art of connecting rigs to riser assemblies.

DETAILED DESCRIPTION

Figure 1:
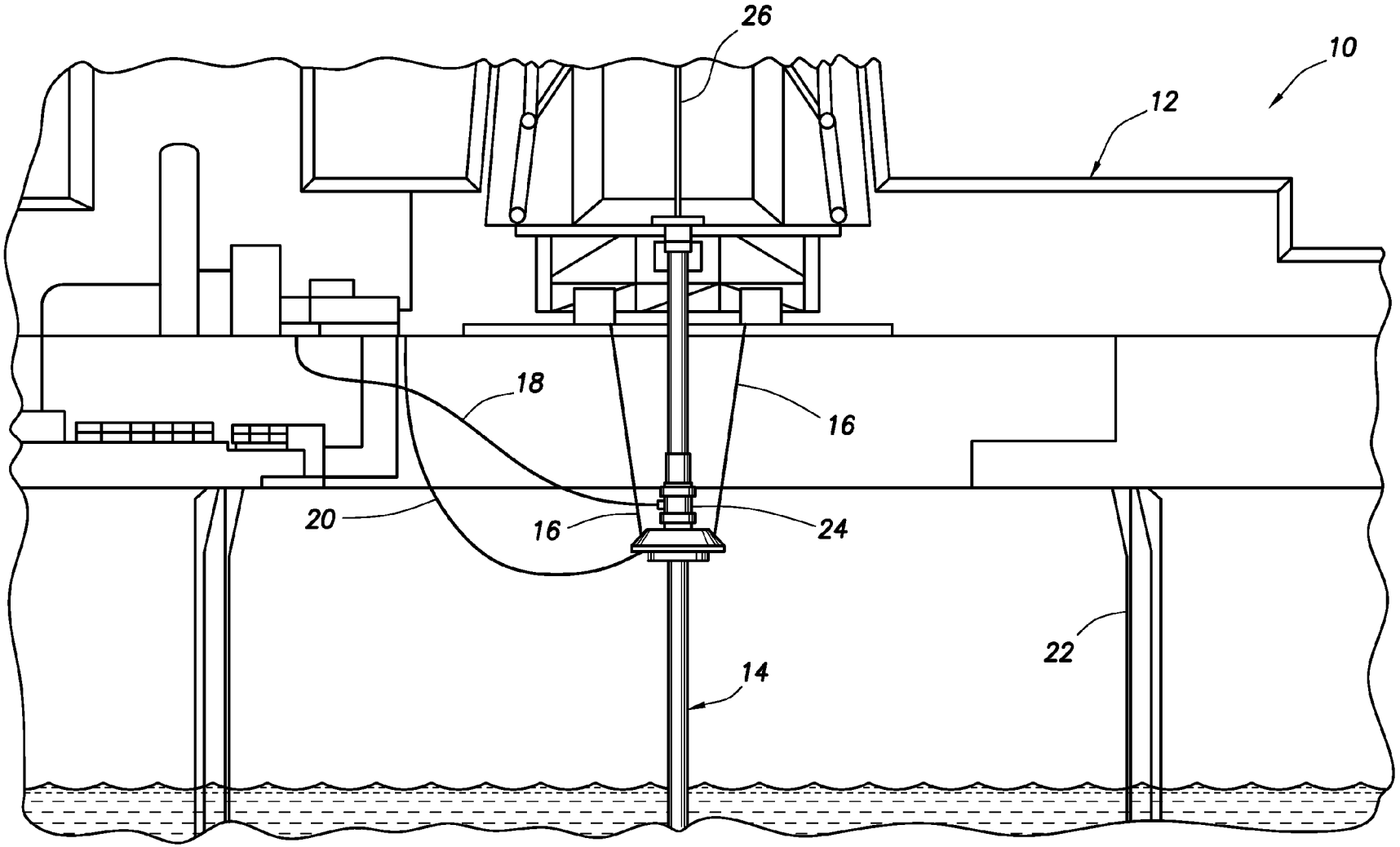
FIG. 1 is a schematic view of a rig system and method which can embody principles of the present disclosure.

Representatively illustrated in FIG. 1 is a rig system 10 which can embody principles of the present disclosure. In the illustrated system 10, a floating drilling rig 12 is of the semi-submersible type. Other types of rigs (such as those on drill ships, etc., and especially those that comprise a floating vessel 22) can benefit from the principles of this disclosure.

The rig 12 supports a riser assembly 14 via tensioner cables 16. Various other lines (such as a choke or mud return line 18 and a kill line 20) extend between the rig 12 and the riser assembly 14.

As the vessel 22 heaves and otherwise moves in response to wave action, current, wind, etc., there is substantial relative displacement between the rig 12 and the riser assembly 14. This makes the area of the rig 12 surrounding the top of the riser assembly 14 a fairly hazardous environment, and so it is desirable to minimize human activity in this area.

It is common for a floating rig to rotate relative to a riser assembly. For example, a drill ship will typically turn to point its bow into oncoming waves, in order to minimize rocking of the ship by the waves.

It will be appreciated that, if the rig 12 rotates relative to the riser assembly 14, the lines 18, 20 can become wrapped about the top of the riser assembly, and/or the lines can be damaged, kinked, etc. In the past, such problems would need to be remedied by human intervention to replace damaged lines, reroute lines, reorient equipment, etc.

However, using the principles of this disclosure, as described more fully below, these problems and others like them, which result from relative rotation between the rig 12 and the riser assembly 14 can be avoided, thereby also avoiding the need for humans to venture into the area surrounding the top of the riser assembly to mitigate such problems.

Note that, as depicted in FIG. 1, the lines 18, 20 and cables 16 are secured to the riser assembly 14 at a pressure control device 24. In this example, the pressure control device 24 comprises a rotating control device of the type which seals off an annulus surrounding a tubular string 26 (such as a drill string) therein. However, other types of pressure control devices (such as blowout preventers, pressure control sections, etc.), which could connect to the riser assembly 14 and which could have lines extending to the rig 12, may also benefit from the principles described in this disclosure.

In one unique feature of the rig system 10, the pressure control device 24 rotates as the rig 12 rotates, thereby preventing tangling, kinking, damage, etc. of the lines 18, 20 and cables 16. This rotation of the pressure control device 24 is preferably controllable from a remote location on the rig 12, so that a human is not required to venture into the area surrounding the top of the riser assembly 14 to rotate the pressure control device 24. Most preferably, the rotation of the pressure control device 24 is controlled automatically, based on indications of the vessel 22 position obtained from a rig data acquisition system.

In this manner, any relative rotation between the rig 12 and the pressure control device 24 can be minimized, or even eliminated. Matching of the pressure control device 24 rotation to the rig 12 rotation can even be performed while drilling operations are being conducted, and while the riser assembly 14 and pressure control device are internally pressurized.

Figure 2:
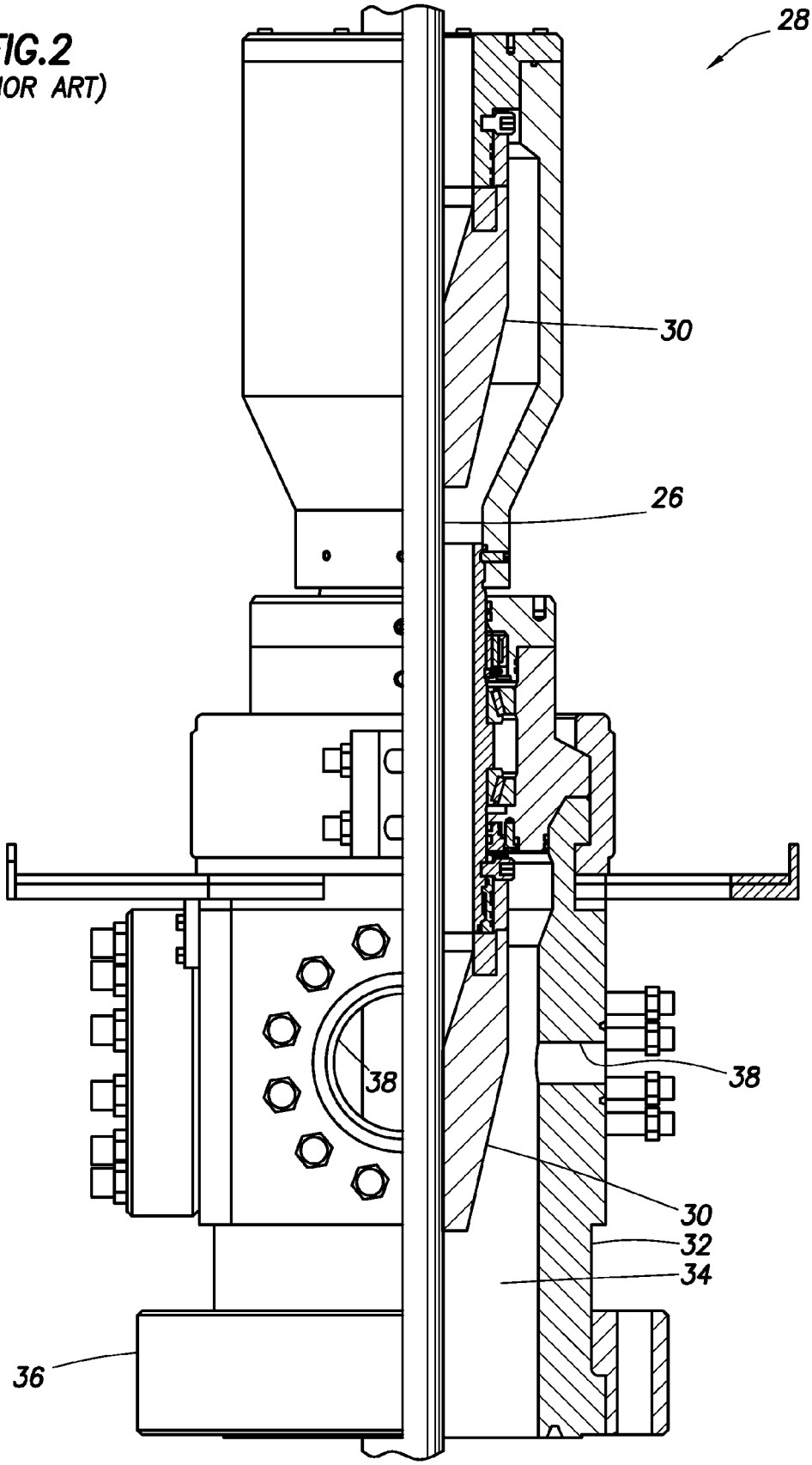
FIG.2 (PRIOR ART)
FIG. 2 is a cross-sectional view of a prior art rotating control device which can be improved utilizing the principles of the present disclosure.

Referring additionally to FIG. 2, a cross-sectional view of a prior art rotating control device 28 is representatively illustrated. The tubular string 26 is also depicted in FIG. 2, so that it may be clearly seen how one or more annular seals 30 in a body 32 of the rotating control device 28 seal off an annulus 34 formed radially between the tubular string and the body.

The seals 30 rotate with the tubular string 26 as it rotates, leading to the term "rotating control device" for this item of equipment, which is typically used in managed pressure drilling and underbalanced drilling operations. Equivalent terms for this item of equipment include "rotating diverter," "rotating control head" and "rotating blowout preventer."

Prior art rotating control devices, such as that depicted in FIG. 2, have been available with manually adjustable lower flanges. In the example of FIG. 2, a lower flange 36 of the rotating control device 28 can be manually rotated relative to the body 32 of the rotating control device, in order to align openings 38 in the body with other rig equipment, as needed.

However, once securely connected to a riser assembly by the lower flange 36, no further rotation of the body 32 relative to the riser assembly can be effected. During drilling operations, or at any time the body 32 is internally pressurized, there can be no rotation of the body 32 relative to the flange 36, and so the body cannot be rotated to maintain a substantially fixed orientation relative to a rig while the rig rotates relative to the riser assembly.

Figure 3:
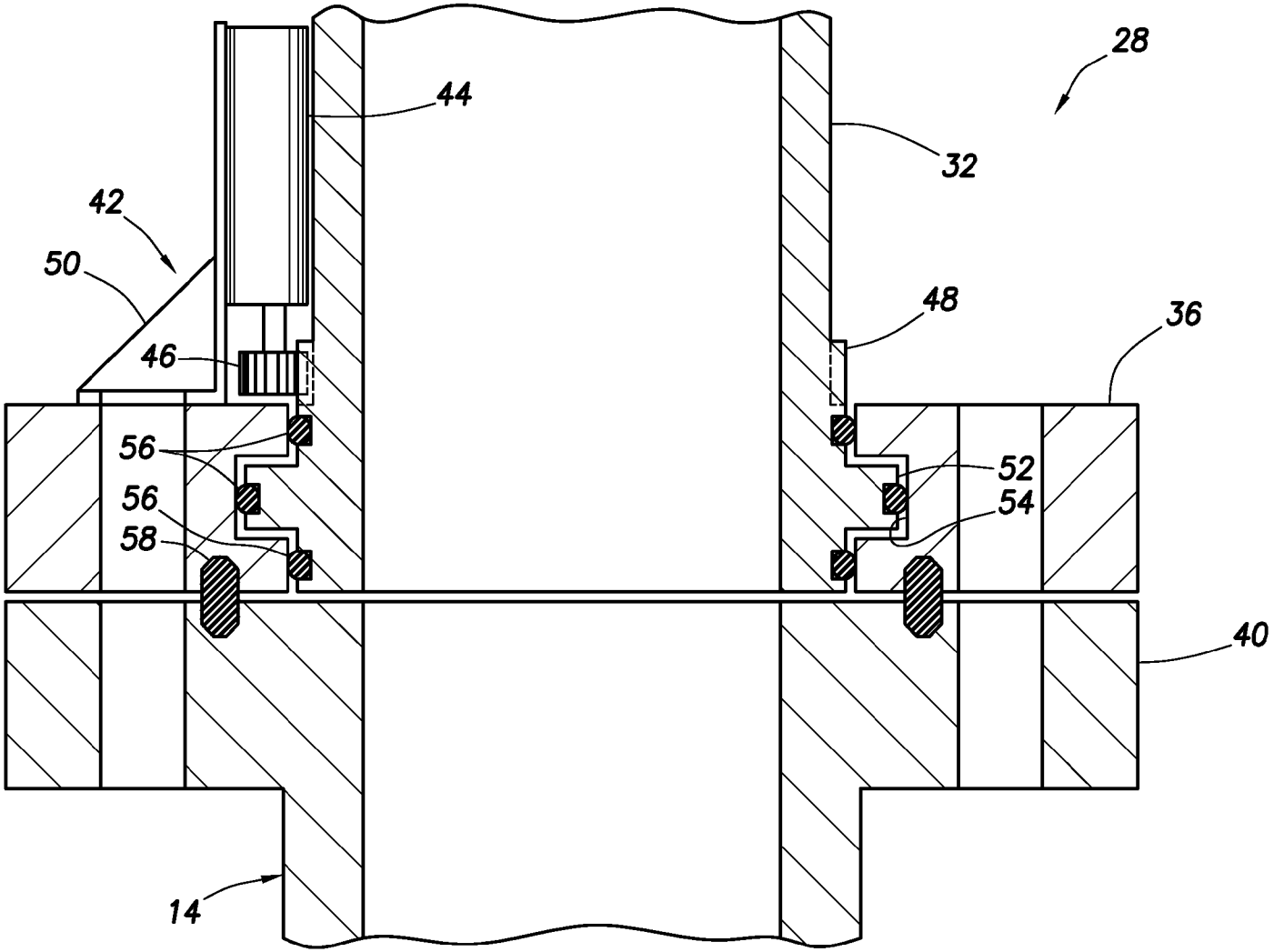
FIGS. 3-6 are schematic cross-sectional views of various configurations of orientation devices which embody principles of the present disclosure.

Referring additionally now to FIG. 3, a schematic cross-sectional view of an improvement to the rotating control device 28 according to the principles of this disclosure is representatively illustrated. This improvement allows the body 32 to rotate relative to the lower flange 36 while the flange is securely connected to a riser flange 40, and while the body and riser assembly 14 are internally pressurized.

As depicted in FIG. 3, the rotating control device 28 includes an orientation device 42 which changes a rotational orientation of the body 32 relative to the flanges 36, 40. In this example, the orientation device 42 includes a motor 44, a pinion gear 46 which is rotated by the motor, and a ring gear 48 which is secured to (or formed as part of) the body 32.

The motor 44 is secured to the flange 36 (for example, by a bracket 50). When the motor 44 rotates the gear 46, the engagement between the gears 46, 48 causes a torque to be applied to the body 32, thereby causing the body to rotate relative to the flange 36.

Rotation of the gear 46 in one direction causes rotation of the body 32 in a corresponding direction, and reverse rotation of the gear causes corresponding reverse rotation of the body. Thus, the body 32 can be made to rotate in the same direction (as well as the same amount of rotation) as the rig 12 rotates relative to the riser assembly 14.

The motor 44 may be an electric, hydraulic, pneumatic or other type of motor. In addition, any other means of rotating the body 32 relative to the flanges 36, 40 may be used in keeping with the principles of this disclosure.

An annular projection 52 formed on the body 32 engages a complementary annular recess 54 in the flange 36, thereby securing the body to the flange, but permitting rotation of the body relative to the flange. Seals 56 (such as o-rings or any other type of seals) prevent fluid leakage from the interior of the rotating control device 28 and riser assembly 14. Another seal 58 seals between the flanges 36, 40.

The motor 44 can be remotely operated, for example, at a location on the rig 12 which is remote from the area surrounding the top of the riser assembly 14. Thus, there is no need for a human to enter the area surrounding the top of the riser assembly 14 in order to rotate the body 32 of the rotating control device 28.

Figure 4:
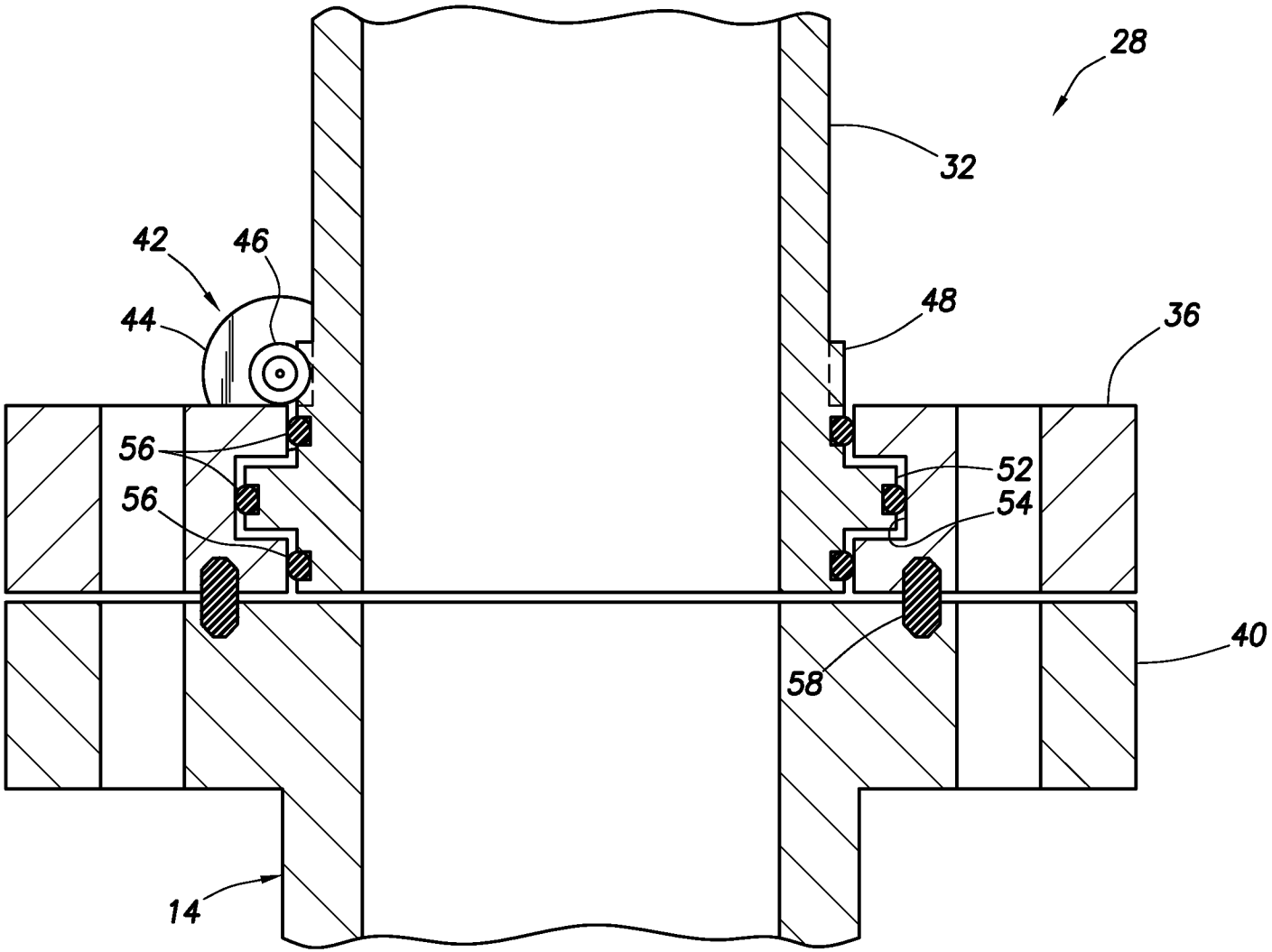

Referring additionally now to FIG. 4, another configuration of the rotating control device 28 is representatively illustrated. In this configuration, the motor 44 and gear 46 are rotated ninety degrees relative to their position in the configuration of FIG. 3.

Figure 5:
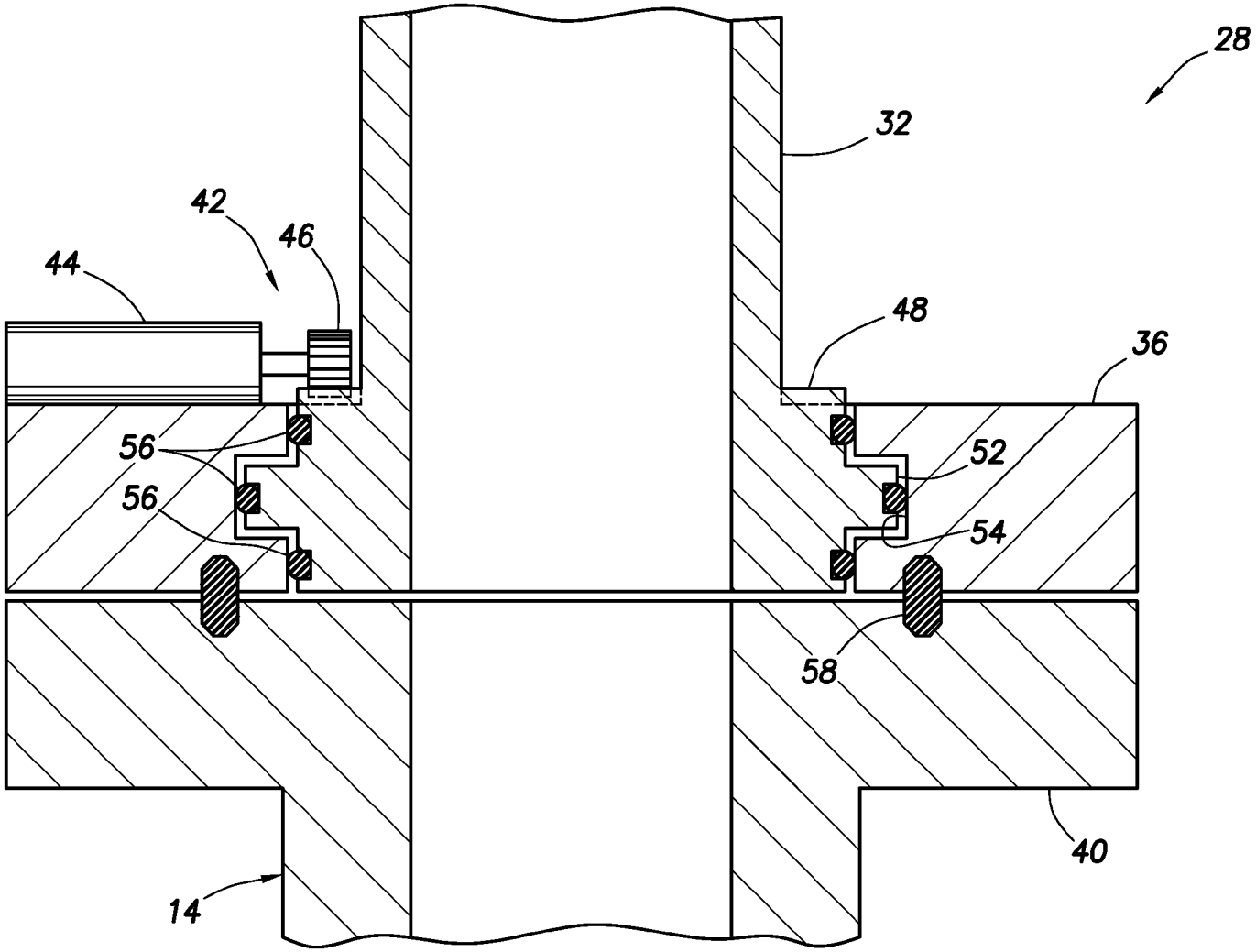

Similarly, in FIG. 5, another configuration of the rotating control device 28 is representatively illustrated, in which the motor 44 and gear 46 are rotated ninety degrees relative to their positions in the configurations of FIGS. 3 & 4. These figures demonstrate that a variety of different configurations of the orientation device 42 are possible, and that the principles of this disclosure are not limited to only the illustrated configurations.

Figure 6:
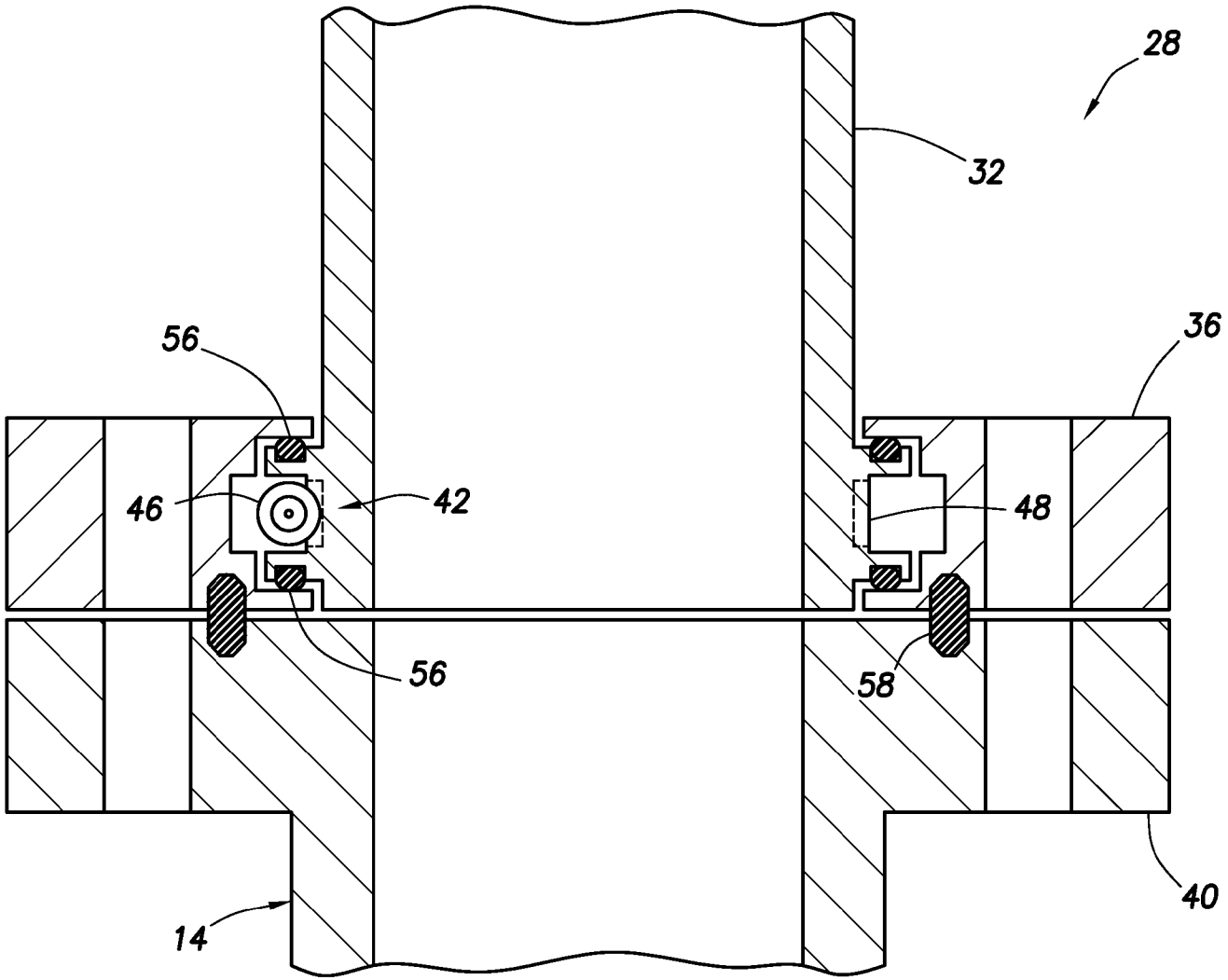

Yet another configuration of the orientation device 42 is representatively illustrated in FIG. 6. In this configuration, the orientation device 42 is positioned within the flange 36. This configuration has certain advantages, in that the components of the orientation device 42 (e.g., the motor 44 and gears 46, 48) are protected from damage, and the area surrounding the orientation device may be packed with lubricant to enhance performance of the device.

Figure 7:
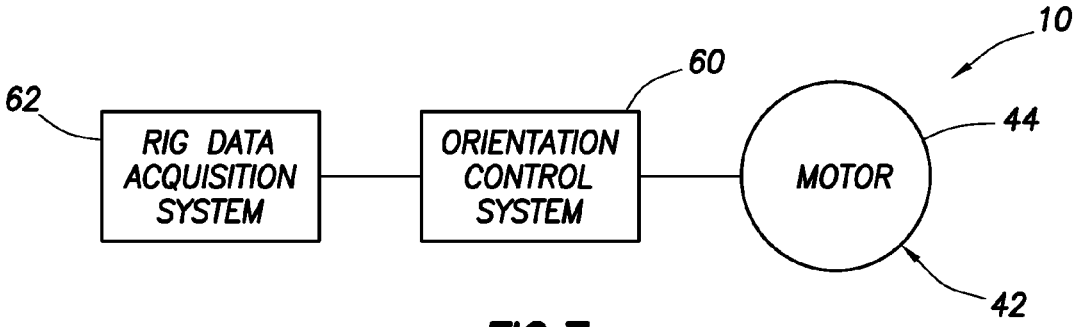
FIG. 7 is a schematic diagram showing how an orientation control system interconnects with a rig data acquisition system and the orientation device.

Referring additionally now to FIG. 7, a schematic diagram is representatively illustrated. This diagram shows how an orientation control system 60 can interconnect with a rig data acquisition system 62 and the orientation device 42.

A typical rig 12 will have the data acquisition system 62 which collects, stores and makes available information regarding rig operations. In one unique feature of the rig system 10, the orientation control system 60 receives an indication of the position of the rig 12 from the rig data acquisition system 62. The orientation control system 60 can, thus, readily determine how the orientation device 42 should be operated to maintain a fixed rotational orientation between the body 32 and the rig 12.

The orientation control system 60 causes the motor 44 to be operated as needed, so that the rotation of the body 32 matches the rotation of the rig 12 relative to the riser assembly 14. Preferably, such operation of the orientation device 42 by the orientation control system 60 is performed automatically, upon receipt of periodic or continuous updated rig 12 position information from the rig data acquisition system 62. In this manner, no human intervention is needed to maintain proper orientation of the body 32 relative to the rig.

Figure 8:
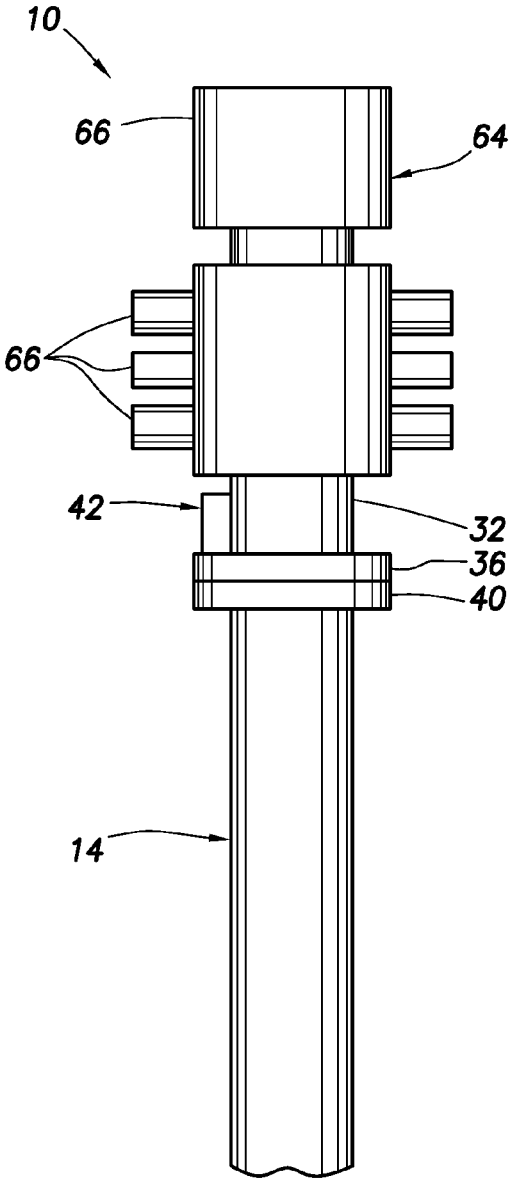
FIG. 8 is a schematic side view of another well system and method which can embody principles of the present disclosure.

Referring additionally now to FIG. 8, another configuration of the system 10 is representatively illustrated. In this configuration, a blowout preventer stack 64 (comprising multiple blowout preventers 66) is connected to the riser assembly 14 in place of, or in addition to the rotating control device 28.

It will be readily appreciated by those skilled in the art that the blowout preventer stack 64 is a pressure control device and will have multiple lines (not shown) extending to the rig 12. Thus, it will also be appreciated that the principles of this disclosure can be beneficially used in conjunction with the blowout preventer stack 64, in a similar manner to that described above for the rotating control device 28, so that a rotational orientation of the blowout preventer stack relative to the rig 12 can be maintained.

As depicted in FIG. 8, the orientation device 42 is used to rotate a body 32 of the blowout preventer stack 64 relative to the riser assembly 14. The orientation control system 60 can be used as described above to maintain a fixed rotational orientation of the blowout preventer stack 64 relative to the rig 12.

Figure 9:
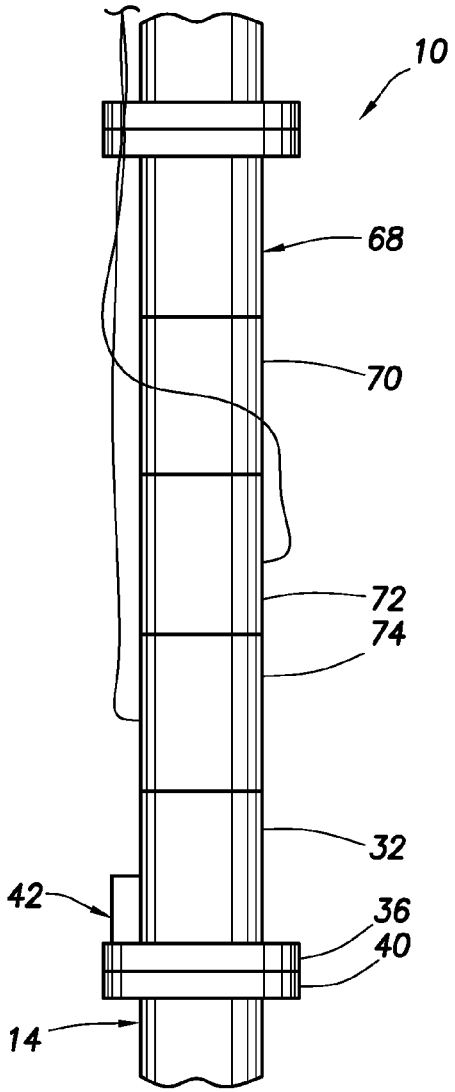
FIG. 9 is a schematic side view of yet another well system and method which can embody principles of the present disclosure.

Referring additionally now to FIG. 9, another configuration of the system 10 is representatively illustrated. In this configuration, a pressure control section 68 (comprising a rotating control device 70, a fluid return 72 and an injection sub 74) is connected to the riser assembly 14 in place of, or in addition to the rotating control device 28. An example of such a pressure control section is described in International Patent Application Serial No. PCT/US07/83974.

It will be readily appreciated by those skilled in the art that the pressure control section 68 is a pressure control device and will have multiple lines extending to the rig 12. Thus, it will also be appreciated that the principles of this disclosure can be beneficially used in conjunction with the pressure control section 68, in a similar manner to that described above for the rotating control device 28, so that a rotational orientation of the pressure control section relative to the rig 12 can be maintained.

As depicted in FIG. 9, the orientation device 42 is used to rotate a body 32 of the pressure control section 68 relative to the riser assembly 14 below the pressure control section. The orientation control system 60 can be used as described above to maintain a fixed rotational orientation of the pressure control section 68 relative to the rig 12.

Note that, although the system 10 has been described above as comprising a floating drilling rig 12, it is not necessary in keeping with the principles of this disclosure for the rig to be floating or otherwise movable during operation. For example, the orientation device 42 can be beneficially used to orient the pressure control device 24 connected to riser or casing, where a land-based rig, jack-up rig, tension-leg rig (or other rig which is stationary during operation) is used. Remote operation of the orientation device 42 provides substantial advantages, even where the rig is stationary, or the rig does not otherwise rotate relative to the riser or casing.

It may now be fully appreciated that the above disclosure provides many advancements to the art of constructing rig systems. In examples described above, safety is enhanced (due to elimination of the necessity for humans to repair or replace damaged lines in the area surrounding the top of a riser assembly), and rig efficiency is improved.

In particular, the above disclosure describes a method of maintaining a substantially fixed orientation of a pressure control device 24 relative to a movable rig 12. The method can include rotating a body 32 of the pressure control device 24 while the rig 12 rotates.

Rotating the body 32 may include substantially matching a rotation of the body with a rotation of the rig 12, rotating the body 32 in a same direction and amount as a rotation of the rig 12 and/or minimizing any change in the orientation of the pressure control device 24 relative to the rig 12.

The rig 12 may be a floating rig and/or a drilling rig.

The pressure control device 24 can be connected to a riser flange 40. The rig 12 may rotate relative to the riser flange 40.

The pressure control device 24 may comprise a rotating control device 28. The body 32 may contain an annular seal 30 which seals against a tubular string 26 in the body while the tubular string rotates. The annular seal 30 may rotate within the body 32 while the annular seal seals against the rotating tubular string 26.

Rotating the body 32 may comprise rotating the body while the body is internally pressurized.

The pressure control device 24 may comprise a blowout preventer 66. The pressure control device 24 may comprise a pressure control section 68 of a riser assembly 14.

Rotating of the body 32 may be controlled at a location on the rig 12 remote from the body.

The method can include receiving a vessel position indication from a rig data acquisition system 62, and automatically controlling the orientation of the pressure control device 24 relative to the rig 12 in response to the vessel position indication. An orientation control system 60 may automatically maintain an orientation of the body 32 relative to a floating vessel 22.

Another method of remotely controlling an orientation of a pressure control device 24 relative to a movable rig 12 is described by the above disclosure. The method can include rotating a body 32 of the pressure control device 24 and controlling the rotation of the body 32, with the controlling being performed at a location on the rig 12 remote from the body 32.

Rotating the body 32 may be performed while the rig 12 rotates.

Also described above is a pressure control device 24 for use in conjunction with a rig 12. The pressure control device 24 can include a body 32, a flange 36, an orientation device 42 which changes a rotational orientation of the body relative to the flange, and an orientation control system 60 which remotely controls the orientation device 42.

The orientation device 42 may include a motor 44. The motor 44 may turn a first gear 46 which engages a second gear 48 secured to the body 32.

The orientation control system 60 can receive a vessel 22 position indication from a rig data acquisition system 62. The orientation control system 60 may automatically control the orientation device 42 in response to the vessel 22 position indication.

The orientation control system 60 can automatically maintain an orientation of the body 32 relative to a floating vessel 22.

The pressure control device 24 may include an annular seal 30 within the body 32, with the annular seal being of the type which rotates within the body while sealing against a tubular string 26 disposed within the body.

The pressure control device 24 may comprise a blowout preventer 66.

The pressure control device 24 may comprise a pressure control section 68 of a riser assembly 14.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of maintaining a substantially fixed orientation of a pressure control device relative to a rotatable rig, the method comprising:

providing a pressure control device, whereby a body of the pressure control device is rotatable relative to the rig;

receiving a rig position indication from a rig data acquisition system; and automatically rotating the body in response to the indication to maintain a rotational orientation of the body relative to the rig.

2. The method of claim 1, wherein rotating the body comprises substantially matching the rotation of the body with the rotation of the rig.

3. The method of claim 1, wherein rotating the body comprises rotating the body in a same direction and amount as the rotation of the rig.

4. The method of claim 1, wherein rotating the body comprises minimizing any change in the orientation of the pressure control device relative to the rig.

5. The method of claim 1, wherein the rig is a floating rig.

6. The method of claim 1, wherein the rig is a drilling rig.

7. The method of claim 1, wherein the pressure control device is connected to a riser flange, and wherein the rig rotates relative to the riser flange.

8. The method of claim 1, wherein the pressure control device comprises a rotating control device.

9. The method of claim 8, wherein the body contains an annular seal which seals against a tubular string in the body while the tubular string rotates.

10. The method of claim 9, wherein the annular seal rotates within the body while the annular seal seals against the rotating tubular string.

11. The method of claim 1, wherein rotating the body comprises rotating the body while the body is internally pressurized.

12. The method of claim 1, wherein the pressure control device comprises a blowout preventer.

13. The method of claim 1, wherein the pressure control device comprises a pressure control section of a riser assembly.

14. The method of claim 1, wherein rotating the body is controlled at a location on the rig remote from the body.

15. The method of claim 1, further comprising automatically controlling the orientation of the pressure control device relative to the rig in response to the vessel position indication.

16. The method of claim 1, wherein an orientation control system automatically maintains an orientation of the body relative to a floating vessel.

17. A method of remotely controlling an orientation of a pressure control device relative to a rotatable rig, the method comprising:

rotating a body of the pressure control device, whereby the body is rotatable relative to the rig;

receiving a vessel position indication from a rig data acquisition system; and controlling the rotation of the body in response to the vessel position indication to maintain a rotational orientation of the body relative to the rig, the controlling being performed at a location on the rig remote from the body.

18. The method of claim 17, wherein rotating the body is performed while the rig rotates.

19. The method of claim 17, wherein rotating the body comprises substantially matching the rotation of the body with the rotation of the rig.

20. The method of claim 17, wherein rotating the body comprises rotating the body in a same direction and amount as the rotation of the rig.

21. The method of claim 17, wherein rotating the body comprises minimizing any change in the orientation of the pressure control device relative to the rig.

22. The method of claim 17, wherein the rig is a floating rig.

23. The method of claim 17, wherein the rig is a drilling rig.

24. The method of claim 17, wherein the pressure control device is connected to a riser flange, and wherein the rig rotates relative to the riser flange.

25. The method of claim 17, wherein the pressure control device comprises a rotating control device.

26. The method of claim 25, wherein the body contains an annular seal which seals against a tubular string in the body while the tubular string rotates.

27. The method of claim 26, wherein the annular seal rotates within the body while the annular seal seals against the rotating tubular string.

28. The method of claim 17, wherein rotating the body comprises rotating the body while the body is internally pressurized.

29. The method of claim 17, wherein the pressure control device comprises a blowout preventer.

30. The method of claim 17, wherein the pressure control device comprises a pressure control section of a riser assembly.

31. The method of claim 17, wherein the controlling step further comprises automatically controlling the orientation of the pressure control device relative to the rig in response to the vessel position indication.

32. The method of claim 17, wherein an orientation control system automatically maintains an orientation of the body relative to a floating vessel.

* * * * *